US006708381B2

(12) United States Patent
Strandqvist et al.

(10) Patent No.: US 6,708,381 B2
(45) Date of Patent: Mar. 23, 2004

(54) METHOD AND DEVICE FOR PRODUCING A NONWOVEN MATERIAL

(75) Inventors: Mikael Strandqvist, Dälavägen (SE); Hannu Ahoniemi, Prästgårdsvägen (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 10/287,001

(22) Filed: Nov. 4, 2002

(65) Prior Publication Data

US 2003/0088956 A1 May 15, 2003

Related U.S. Application Data

(63) Continuation of application No. PCT/SE01/00940, filed on May 3, 2001.

(51) Int. Cl.[7] ..... D06B 1/02

(52) U.S. Cl. ..... 28/104; 28/167

(58) Field of Search ..... 28/104, 105, 106, 28/167, 163; 156/148; 264/504; 162/115, 202, 211, 212, 208, 217, 289, 297, 310, 348, 351, 357

(56) References Cited

U.S. PATENT DOCUMENTS

| | | | | | |
|---|---|---|---|---|---|
| 3,034,180 | A | * | 5/1962 | Greiner et al. | 28/104 |
| 3,113,349 | A | * | 12/1963 | Nottebohm et al. | 28/104 |
| 3,531,363 | A | | 9/1970 | Shambelan | |
| 4,297,404 | A | * | 10/1981 | Nguyen | 28/105 |
| 5,098,764 | A | * | 3/1992 | Drelich et al. | 28/104 |
| 5,274,893 | A | * | 1/1994 | Kitamura et al. | 28/105 |
| 5,301,401 | A | * | 4/1994 | Suzuki et al. | 28/167 |
| 5,718,022 | A | * | 2/1998 | Vuillaume | 28/105 |
| 5,759,929 | A | * | 6/1998 | Ikezawa et al. | 28/104 |
| 5,895,623 | A | * | 4/1999 | Trokhan et al. | 28/104 |
| 6,055,710 | A | * | 5/2000 | Fleissner | 28/104 |
| 6,058,583 | A | * | 5/2000 | Takeuchi et al. | 28/104 |
| 6,080,471 | A | * | 6/2000 | Shigematsu et al. | 28/104 |
| 6,324,738 | B1 | * | 12/2001 | Fleissner | 28/104 |

FOREIGN PATENT DOCUMENTS

| | | |
|---|---|---|
| EP | 0223614 A2 | 5/1987 |
| WO | 92/17643 A1 | 10/1992 |
| WO | 98/35742 A1 | 8/1998 |

* cited by examiner

*Primary Examiner*—A. Vanatta
(74) *Attorney, Agent, or Firm*—Burns, Doane, Swecker & Mathis, L.L.P.

(57) ABSTRACT

A method and device for manufacturing a nonwoven material by hydroentangling a fiber web by water jets at a high pressure, wherein the fiber web is supported by a moulded, close-meshed screen (12) of a thermoplastic material during the hydroentanglement. The screen can be reinforced with reinforcement wires (14).

9 Claims, 2 Drawing Sheets

METHOD AND DEVICE FOR PRODUCING A NONWOVEN MATERIAL

This application is a continuation application of PCT/SE01/00940, filed May 3, 2001 claims priority under 35 U.S.C. §§119 to Swedish Patent Application No. 0001688-1 filed in Sweden on May 8, 2000; the entire contents of which are hereby incorporated by reference.

TECHNICAL FIELD

The present invention relates to a method and a device for manufacturing a nonwoven material by hydroentangling a fibre web.

BACKGROUND OF THE INVENTION

Hydroentanglement or spunlacing is a technique which was introduced in the 1970-ies, see e.g. the patent No. CA 841 938. The technology involves forming either a dry-laid or wet-laid fibre web, whereafter the fibres are entangled, i.e. intertwined, by means of very fine water jets at a high pressure. Several rows of water jets are directed towards the fibre web which is supported by a moving wire. The entangled fibre web is then dried. The fibres which are used in the material can be constituted of synthetic or regenerated staple fibres, e.g. polyester, polyamide, polypropylene, rayon and the like, of pulp fibres, or mixtures of pulp fibres and staple fibres. Spunlaced materials can be manufactured with a high quality at a reasonable cost and exhibit a high absorption capacity. For instance, they are utilised as wiping materials for domestic or industrial use, as disposable materials within medical care and hygiene, etc.

During the entanglement, the fibre web is supported by either a wire or a perforated, cylindrical metal drum. An example of a hydroentanglement unit of the latter type is disclosed e.g. in EP-A-0 223 614. This type of hydroentanglement unit makes great demands upon the sealing of the suction boxes. However, supporting members in the form of wires of the type utilised in connection with paper production is the most frequently occurring type.

One disadvantage with such wires is that the fibre web, as a result of the strong action it is subjected to during the hydroentanglement, penetrates into and is caught between the wire threads, wherein it can be difficult to separate the final product from the wire in some cases. Furthermore, a woven wire results in limitations when choosing the structure and pattern of the final product which can be created in connection with the entanglement.

OBJECT AND SUMMARY

An object of the present invention is to provide a method and a device for manufacturing a nonwoven material by hydroentangling a fibre web, wherein the problem with removing the final product from the supporting member (wire) has been eliminated or at least reduced. According to one embodiment of the invention, this has been achieved by means of the fibre web being supported by a moulded screen of a thermoplastic material during the hydroentanglement.

In addition to the simplified removal of the final product from the supporting member, a moulded plastic screen also provides increased possibilities to create the desired aperture patterns and structures in a simple way in the nonwoven material which is manufactured.

Preferably, the moulded plastic screen is reinforced with reinforcement wires. The surface which supports the fibre web can be smooth or structured.

Another embodiment of the invention further relates to the use of a moulded, close-meshed screen of a thermoplastic material for supporting a fibre web during a hydroentanglement process. Today, such moulded plastic screens are utilised as a base material for manufacturing press felts for paper machines, wherein a fibrous material is laminated to the screen. However, according to this embodiment of the invention, only the base material in the form of the moulded plastic screen is utilised as a supporting material during the hydroentanglement.

DESCRIPTION OF DRAWINGS

In the following, the invention will be described in greater detail with reference to several embodiments shown in the attached drawings.

DESCRIPTION OF EMBODIMENTS

Figure 1:
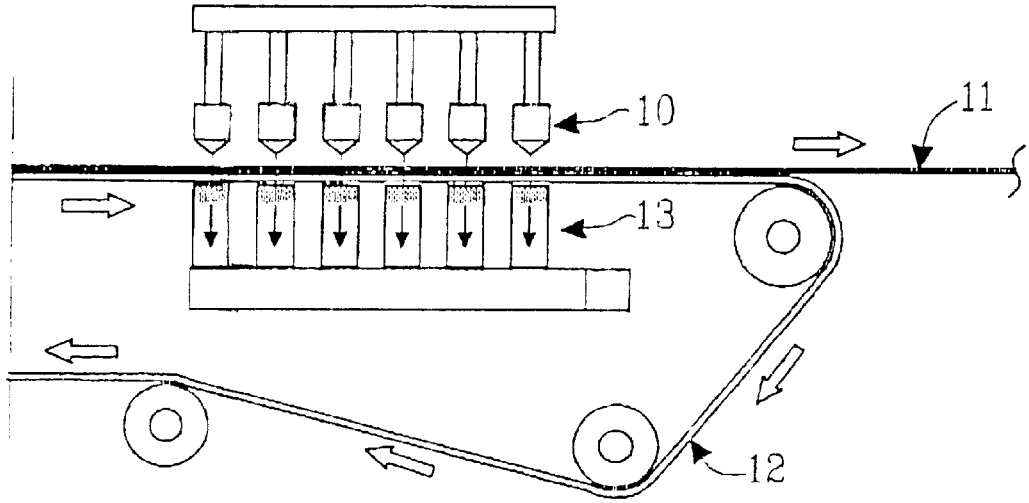
FIG. 1 schematically shows a device for hydroentangling a fibre web.

The embodiment which schematically is shown in FIG. 1, for manufacturing a so-called spunlaced material, comprises several rows of nozzles 10 from which water jets at a very high pressure are directed towards a fibre web 11 which is supported by a supporting member 12 which, according to a preferred embodiment of the invention, is constituted of a moulded screen of thermoplastic material. Thereby, the water jets accomplish an entanglement of the fibre web, i.e., an intertwining of the fibres. An appropriate pressure in the entanglement nozzles is adapted to the fibre material, grammage of the fibre web, etc. The fibre web 11 can be of an optional type, dry-laid, wet-laid or foam-formed and the fibres can be both natural fibres, e.g., cellulosic fibres, and synthetic fibres of staple length or continuous filaments. Also so-called split fibres and/or splittable filaments can be included, i.e., fibres or filaments which partially are divided (split) in connection with the hydroentanglement. Also mixtures of different fibre types can be included in the fibre web.

For a further description of the hydroentanglement or, as it is also called, spunlacing technology, reference is made e.g. to the above-mentioned CA-patent No. 841 938.

The entangled material is drained over suction boxes 13 and is then brought to a drying station for drying before the finished material is reeled up and converted. The water from the entanglement nozzles is removed via the suction boxes 13 and is pumped to a water purification plant, wherafter it is re-circulated to the entanglement stations.

Figure 2:
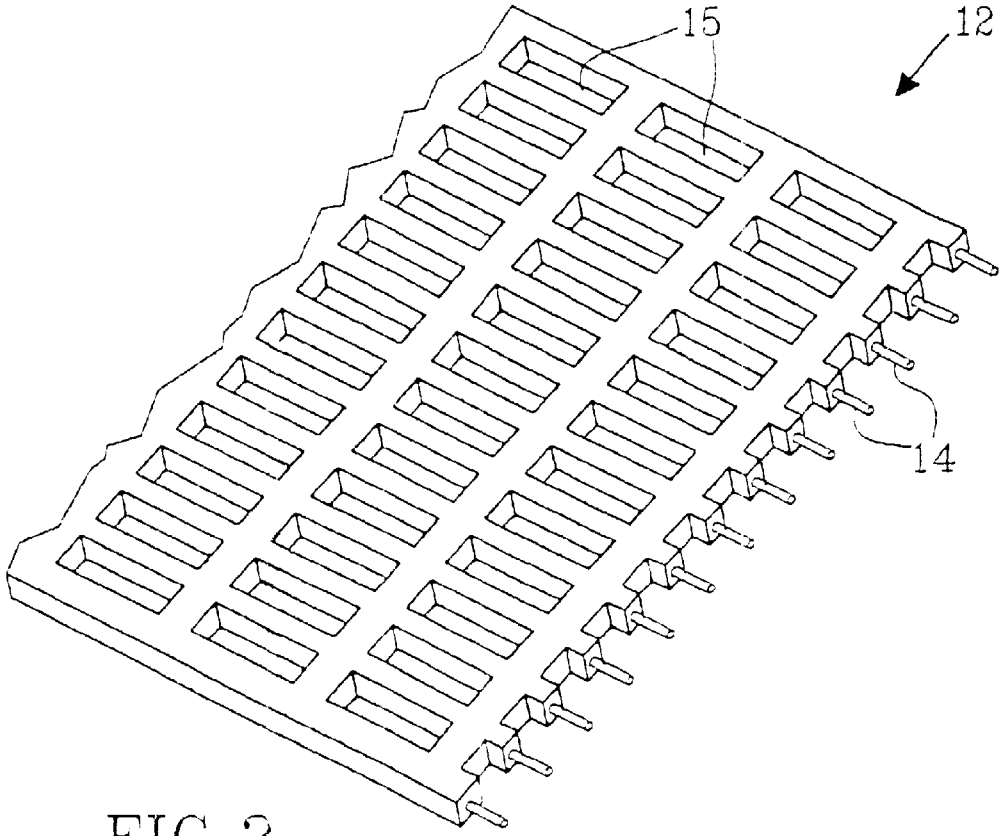
FIG. 2, shows a schematic perspective view, in enlarged scale, of a screen according to an embodiment of the invention.
Figure 3:
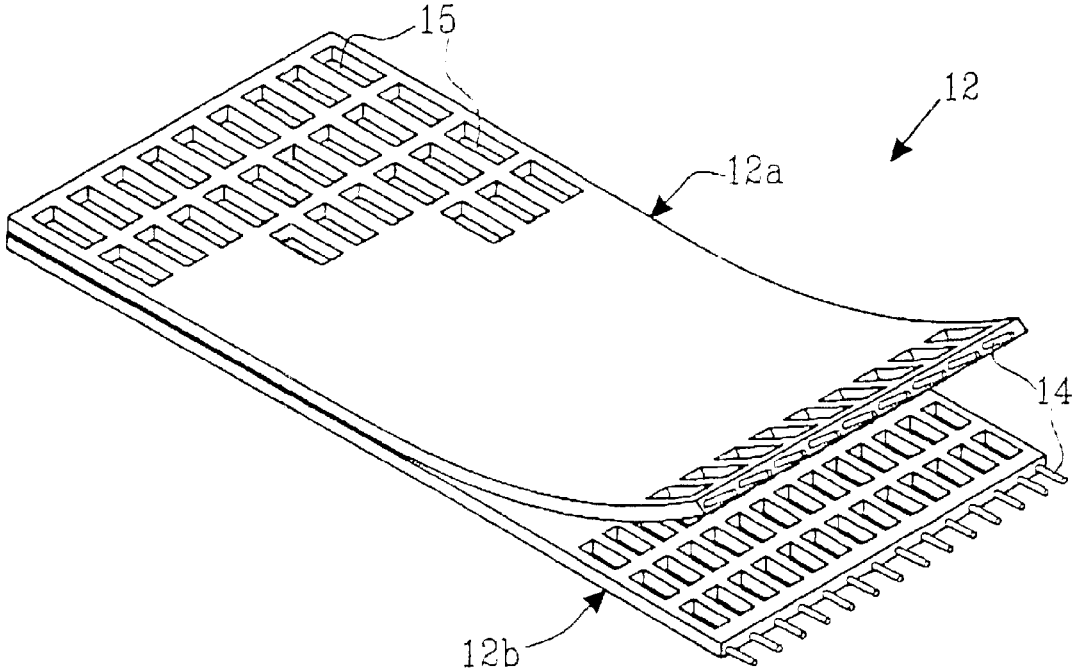
FIG. 3 shows a schematic perspective view of another embodiment of the screen according to the invention.
Figure 4:
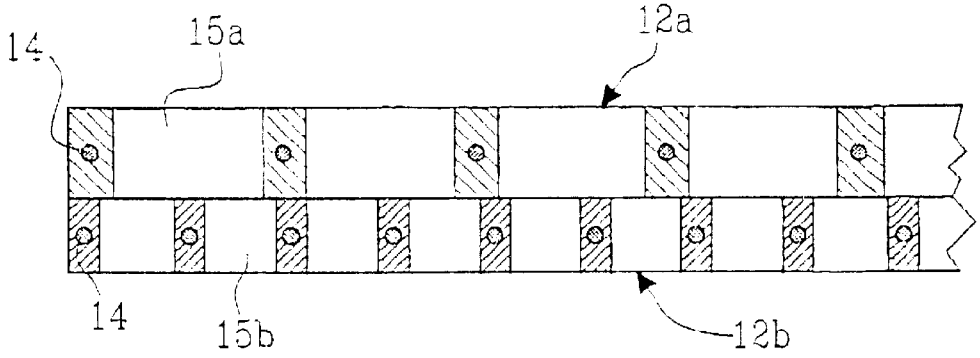
FIG. 4 shows a section through the screen in FIG. 3.

The supporting member 12 which supports the fibre web during the hydroentanglement is constituted of a moulded, close-meshed plastic screen, for example of the type disclosed in WO 92/17643 or in WO 98/35742, and which according to these documents is utilised as a base material for a press felt of a paper machine. The plastic screen according to the embodiments can consist of one layer, as shown in FIG. 2, or of two or several layers applied on top of each other, in accordance with FIGS. 3 and 4. Possibly, the screen can be reinforced with reinforcement wires 14, which extend in the intended machine direction of the plastic screen/entanglement wire 12. Reinforcement wires can be arranged also in the transverse direction of the screen, or both in the longitudinal and the transverse direction. The production of the plastic screen can take place e.g. in the way described in U.S. Pat. No. 4,740,409.

A suitable material for manufacturing the screen is thermoplastic polyurethane, whereas the reinforcement wires 14 can consist of an optional mono- or multifilament yarn exhibiting a good binding ability to the thermoplastic material in the screen.

The surface which is intended to support the fibre web can be substantially smooth, or exhibit a three-dimensional structure in order to impart a corresponding three-dimensional structure to the hydroentangled material. According to one embodiment, a layer exhibiting a desired aperture pattern and/or a desired three-dimensional structure has been applied onto the screen. Such a layer can be accomplished, according to one embodiment, by means of coating the plastic screen with a photosensitive polymer material which is exposed to light through a mask, whereafter the non-cured material is removed. In this way, a large freedom can be achieved when the choice of pattern is concerned.

In the embodiments shown in the drawings, the apertures 15 in the screen exhibit a rectangular shape, but it is evident that this shape can be varied. The meshes in the screen suitably exhibit an aperture size within the interval 0.2–4 mm, preferably 0.5–2 mm. The apertures are either of substantially the same size or of different sizes, and are either uniformly distributed across the screen or arranged to form patterns with alternating groups of apertures of different sizes. Also the cross-sectional shape of the apertures in the z-direction can be varied, and can be e.g. substantially rectangular, alternatively convex or concave.

In case the screen consists of two or several layers arranged on top of each other, the different layers can exhibit different aperture sizes among themselves, e.g. with larger apertures 15*a* in the upper layer 12*a* and smaller apertures 15*b* in the lower layer 12*b*. In this way, fibres can penetrate down into the larger apertures in the upper layer but be retained by the lower layer during the entanglement.

One important advantage of the invention is that it enables the production of structured materials with larger thickness at maintained strength.

Naturally, the invention is not limited to the shown embodiments, but can be varied within the scope of the claims. Accordingly, according to an alternative embodiment, the screen can be arranged around a perforated, cylindrical metal drum of the type mentioned by way of introduction.

What is claimed is:

1. A method for manufacturing a nonwoven material, the method comprising:

supporting a fiber web by a supporting member in the form of a moulded, close meshed screen of a thermoplastic material; and hydroentangling the fiber web by water jets at a high pressure, wherein drainage takes place through the supporting member, wherein said screen is reinforced with reinforcement wires.

2. The device according to claim 1, wherein the reinforcement wires are a monofilament or a multifilament yarn.

3. A device for manufacturing a nonwoven material by hydroentangling a fiber web, the device comprising a plurality of nozzles from which water jets at a very high pressure are directed towards the fiber web and a permeable supporting member that supports the fiber web through which supporting member drainage of the fiber web takes place, wherein the supporting member is constituted of a moulded, close-meshed screen of a thermoplastic material, wherein said screen is reinforced with reinforcement wires.

4. The device according to claim 3, wherein the screen has a substantially smooth surface intended to support the fiber web.

5. The device according to claim 3, wherein the screen has a structured surface intended to support the fiber web.

6. The device according to claim 3, wherein the meshes in the screen have an aperture size within the interval 0.2–4 mm.

7. The device according to claim 3, wherein meshes in the screen have apertures of different sizes and the apertures are arranged in groups to form patterns.

8. The device according to claim 6, wherein the interval is 0.5–2 mm.

9. The device according to claim 3, wherein the reinforcement wires are a monofilament or a multifilament yarn.

* * * * *